US005758767A

United States Patent [19]

Hincher

[11] Patent Number: 5,758,767

[45] Date of Patent: Jun. 2, 1998

[54] HOCKEY STICK CARRYING BAG

[76] Inventor: William Hincher, 23 Pittenger Pond Rd, Freehold, N.J. 07728

[21] Appl. No.: 721,042

[22] Filed: Sep. 26, 1996

[51] Int. Cl.[6] ..... B65D 85/20

[52] U.S. Cl. ..... 206/315.1; 224/610

[58] Field of Search ..... 224/610, 913, 224/917; D3/221, 254, 261; 206/315.1, 315.2, 315.3, 315.4, 315.5

[56] References Cited

U.S. PATENT DOCUMENTS

| | | | |
|---|---|---|---|
| 1,092,833 | 4/1914 | Grant . | |
| 2,739,631 | 3/1956 | Hamley | 224/645 X |
| 3,336,961 | 8/1967 | Welsh | 206/315.1 |
| 4,023,800 | 5/1977 | Haggerty | 206/315.1 X |
| 4,191,233 | 3/1980 | McKay | 206/315.1 |
| 4,358,137 | 11/1982 | Gramm . | |
| 4,546,877 | 10/1985 | Evans | 206/315.1 X |
| 5,005,624 | 4/1991 | Sung | 206/315.2 X |
| 5,249,723 | 10/1993 | Lamadalein . | |
| 5,356,013 | 10/1994 | Deloma et al. . | |

*Primary Examiner*—Jes F. Pascua
*Attorney, Agent, or Firm*—Terrance L. Siemens

[57] ABSTRACT

A bag configured to carry and cooperate closely with one or more hockey sticks. The bag has an elongated section and an enlarged head projecting from the elongated section at an obtuse angle. A zipper is disposed upon the enlarged head for access into the bag. The bag has a shoulder sling having snaps for removable attachment to the bag, two rigid, small handles arranged abreast of one another, or both. If a shoulder sling is provided, the sling preferably attaches at one end to the inside of the elbow formed at the juncture of the elongated section and enlarged head. The bag preferably has two external pockets for carrying pucks and rolls of tape. The bag is formed from a flexible material, but in an alternative embodiment, may be formed from a rigid material.

18 Claims, 1 Drawing Sheet

HOCKEY STICK CARRYING BAG

BACKGROUND OF THE INVENTION

1. Field of the Invention

The present invention relates to bags for carrying objects, and more particularly to a bag configured to enclose and carry one or more hockey sticks. The bag is characterized by a head large enough to entirely envelop the contents.

2. Description of the Prior Art

Athletic equipment must frequently be transported by those engaging in the associated activity. In particular, sports having balls or other items which are struck or propelled, and bats or other apparatus for striking the balls or other items, are in need of bags or cases for protecting and carrying the sports equipment. It is well known, for example, that a set of golf clubs requires a suitable bag for conveniently transporting the set.

Hockey sticks may be counted among the various types of sports equipment which must be carried about. The only personal hockey stick carrier known to the applicant is shown in U.S. Pat. No. 5,249,723, issued to Joseph F. M. Lamadalein on Oct. 5, 1993. The subject of this patent comprises a rigid clip having two or more channels for grasping elongated handles of hockey sticks. In contrast, the present invention entirely encloses the contents, has handles for grasping, and pockets to contain ancillary items.

Elongated carrying bags for carrying sports equipment are shown in U.S. Pat. Nos. 1,092,833, issued to Basil Harding Grant on Apr. 14, 1914, and 5,356,013, issued to David M. Deloma et al. on Oct. 18, 1994. These bags fully enclose their respective subject athletic equipment, has a sling for carrying, and an auxiliary pocket for carrying ancillary equipment. However, these bags are not configured to cooperate with a hockey stick, as is the bag of the present invention. And in the case of Grant's bag, which has an enlarged head, no care is taken to minimize bulk of the bag due to location of the sling. By contrast, location of the sling in the present invention minimizes bulk and obtrusiveness.

U.S. Pat. No. 4,358,137, issued to Raymond J. Gramm on Nov. 9, 1982, illustrates a carrier which is essentially a wheeled bag having legs for standing erect. This device has two hand sized loop handles for carrying when not being wheeled on the ground. By contrast, the present invention has a closure located on the enlarged head, has external auxiliary pockets for carrying ancillary items, and is carried by a sling as well as by small handles. Also, the bag of the present invention is configured to cooperate closely with elongated portions of the athletic equipment, rather than having significant internal voids, in the manner of Gramm's device.

None of the above inventions and patents, taken either singly or in combination, is seen to describe the instant invention as claimed.

SUMMARY OF THE INVENTION

The present invention provides a carrying bag uniquely suited for carrying hockey sticks. To this end, the bag has an elongated section and an enlarged head projecting at an oblique angle from the elongated section, and has pockets for carrying ancillary equipment such as pucks and rolls of tape. A closure, such as a zipper, is located at the enlarged head. This enables a hockey stick to be inserted into the bag with the elongated member entering first. This arrangement minimizes length of the closure, while still accommodating relatively great length of the hockey stick.

In alternative embodiments, the hockey stick bag is carried by a shoulder sling or two small handles, or both. The shoulder sling enables carrying while leaving the hands free for other tasks. It should be noted that orientation of the sling and the bag minimizes obtrusiveness and overall bulk of the bag when carrying hockey sticks. The small handles enable close control of the bag. Close control may be required, for example, to negotiate doorways and other obstructions requiring that the bag be maneuvered past the obstruction. If not provided by small rigid handles, the bag would be more difficult to maneuver.

At least two external pockets are provided for carrying ancillary items such as pucks and rolls of tape. Pucks, having smooth surfaces and relatively dense construction, are easily retrieved from a bag. However, rolls of adhesive tape are relatively light for their volume, have somewhat sharp or ragged edges, and some adhesive may be exposed. Therefore, rolls of tape are more likely to bind when being emptied or manually removed from a bag. It is therefore unsuitable to store rolls of tape in a large compartment of a bag. A separate pocket solves these problems, and further assists in preventing contamination of the tape by dirt. Pucks may be contained within pockets specifically dedicated thereto in order to be readily retrieved and segregated from rolls of tape.

Preferably, the hockey stick bag is fabricated from a durable, light weight, flexible material, such as canvas or nylon fabric. It is desired not to increase weight unduly by utilizing a heavy constituent material. Flexibility assists in causing the bag to conform to the stick when inserting hockey sticks, and enabling folding of the bag when not in use.

It may be desirable to protect a hockey stick from scratching and similar damage while enclosed within the bag, for example, when the hockey stick bears a delicate painted logo. An alternative embodiment of the invention accommodates this need by forming the case from a generally rigid material, such as a hard synthetic resin, fiberglass, metal, or a combination of these or other materials.

Accordingly, it is a principal object of the invention to provide a bag for enclosing and carrying one or more hockey sticks.

It is another object of the invention to enable carriage of ancillary items with hockey sticks, while segregating the ancillary items of different types, and separating all ancillary items from the hockey stick or sticks.

It is a further object of the invention to enable carrying of the bag independently of grasping the bag by hand.

Still another object of the invention is to enable maneuvering of the bag around obstructions.

An additional object of the invention is to minimize obtrusiveness of the hockey stick bag.

It is again an object of the invention to fabricate the bag from a light weight, flexible material.

Yet another object of the invention is to fabricate the bag from a generally rigid material.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figures 1, 2:
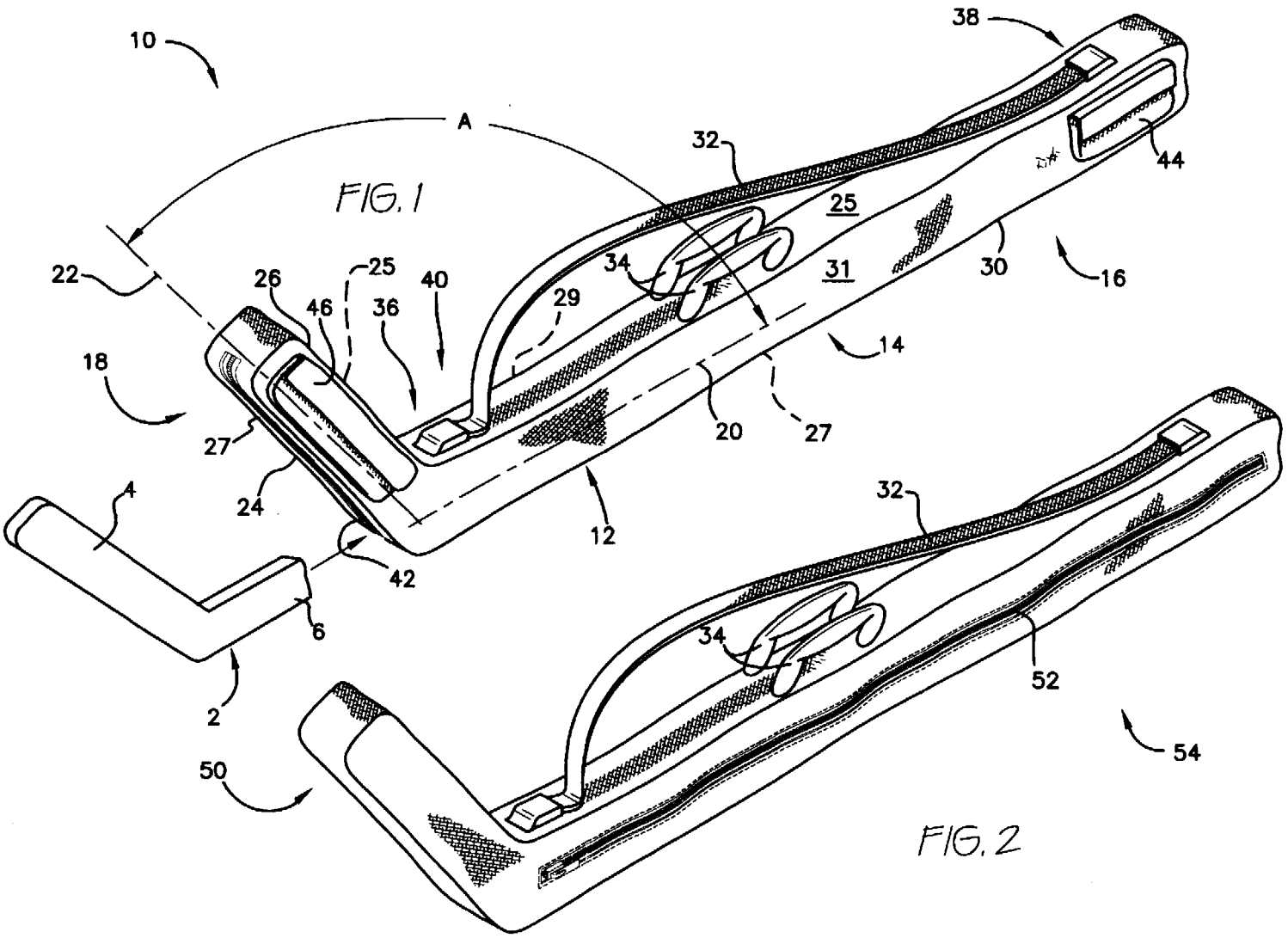
FIG. 1 is an environmental, side perspective view of the invention.
FIG. 2 is a side perspective view of an alternative embodiment of the invention.

FIG. 1 shows a preferred embodiment of the invention, wherein it will be seen that novel bag 10 is configured and dimensioned to enclose and carry one or more hockey sticks 2. Bag 10 comprises a housing member 12 enclosing an interior space 14 therein. Housing member 12 comprises a straight, elongated section 16, and a short, straight enlarged head 18 arranged at an obtuse angle A to elongated section 16. Angle A is formed between longitudinal axis 20 of elongated section 16, and longitudinal axis 22 of enlarged head 18.

Housing member 12 is dimensioned and configured to enclose and closely cooperate with hockey stick 2. Enlarged head 18 encloses the head 4 of hockey stick 2, and elongated section 16 encloses the handle or shaft 6 of hockey stick 2. Elongated section 16 and enlarged head 18 are regarded as straight in that edges 24, 26, 28, 30, when viewed from the side, are straight. Also, edges 24 and 26 are parallel to one another, and edges 28 and 30 are mutually parallel. Outer surfaces of elongated section 16 are parallel to one another. Similarly, outer surfaces of housing member 18 are parallel to one another. Of course, since housing member 18 is preferably fabricated from a flexible material, section 16 and head 18 may be deformed from straight configuration.

Bag 10 is carried by at least one hand grip attached to housing member 12. The embodiment of FIG. 1 depicts three hand grips, including a flexible shoulder sling 32, and two small, rigid handles 34. Each handgrip is raised above and projects outside housing member 18. Sling 32 is anchored to housing member 12 at two widely spaced snap connectors 36, 38, which enable sling 32 to be removed from housing member 12. Snap connectors 36, 38 form points of anchorage disposed one at the distal end of bag 10 and the other towards the proximal end of bag 10.

It is preferred that snap connector 36 be located at elbow 40 formed at the juncture of elongated section 16 and enlarged head 18. This location causes enlarged head 18 to project in a direction rendering bag 10 to be minimally obtrusive and bulky when being carried about.

Rigid handles 34 are of the type frequently encountered with suitcases, tool cases, cases for musical instruments, and the like. They enable a person to maneuver bag 10 around obstructions. Preferably, handles 34 are hinged to housing member 12, but alternatively may be solidly joined thereto. Either one or two handles 34 may be provided. If two, then they are preferably arranged abreast of one another. Handles 34 are small in that their length does not exceed twice the span of the palm of an adult's hand. By contrast, anchorage points of sling 32 are spaced at least three feet or one meter apart.

Bag 10 has a zipper 42 for selectively providing and closing access to interior space 14 of housing member 12. Zipper 42 is preferably located on enlarged head 18, for enabling one or more hockey sticks 2 to be inserted into bag 10 by handle 6 of hockey stick 2.

Bag 10 has two pockets 44 and 46 attached externally to housing member 12. Pockets 44, 46 are for carrying ancillary items (not shown) separately from hockey stick 2. Provision of two pockets 44, 46 assures that different types of ancillary items may be segregated both from one another and from hockey sticks 2. Pockets 44, 46 may be open, or alternatively may include flaps and closures (not shown).

FIG. 2 shows an alternative embodiment wherein bag 50 has a zipper 52 disposed upon elongated section 54. This arrangement enables a hockey stick (not shown in FIG. 2) to be held parallel to and inserted into bag 50.

Of course, the novel bag 10 is susceptible to many variations and modifications which may be introduced by those of skill in the art. One or more pockets may be provided in locations as shown or in different locations. Hand grips may include only sling 32, one or more handles 34, or any combination of hand grips. Closures may include those depicted either individually or in combination, and may be located differently from the arrangements shown.

Bag 10 may be modified to accept more than one hockey stick by, for example, widening housing member 12. If enlarged, housing member 12 could accommodate two, three, or even more hockey sticks arranged abreast and parallel.

It is to be understood that the present invention is not limited to the embodiments described above, but encompasses any and all embodiments within the scope of the following claims.

I claim:

1. A hockey stick bag for enclosing and carrying hockey sticks, comprising:

a housing member enclosing an interior space configured to enclose and closely cooperate with a hockey stick therein, said housing member comprising a straight, elongated section, and a short, straight enlarged head arranged at an obtuse angle to said elongated section in the manner of a hockey stick, said enlarged head and said elongated section having two opposed, common planar surfaces extending along the entire length of said hockey stick bag;

at least one hand grip attached to said housing member, said hand grip raised above and projecting outside said housing member; and a closure disposed upon said housing member, for selectively providing and closing access to said interior space of said housing member.

2. The bag according to claim 1, said closure being located on said enlarged head of said bag, for enabling a hockey stick to be inserted into said bag by the head of the hockey stick.

3. The bag according to claim 1, said closure being located on said elongated section of said bag, whereby a hockey stick may be held parallel to and inserted into said bag.

4. The bag according to claim 1, said hand grip comprising a shoulder sling attached to said housing member.

5. The bag according to claim 4, said elongated section and said enlarged head of said housing member meeting at a juncture, said housing member having an elbow formed at the juncture of said elongated section and said enlarged head, said bag having a distal end, said shoulder sling having a first point of anchorage disposed at said distal end of said bag and a second point of anchorage disposed inside said elbow of said bag.

6. The bag according to claim 4, further comprising means for removably attaching said shoulder sling to said housing member.

7. The bag according to claim 1, said hand grip comprising at least one small, rigid handle attached to said housing member.

8. The bag according to claim 1, said hand grip comprising two small, rigid handles located abreast of one another and attached to said housing member.

9. The bag according to claim 1, further comprising at least one external pocket for carrying ancillary items separately from hockey sticks, said external pocket disposed upon said housing member.

10. The bag according to claim 1, further comprising at least two external pockets for carrying at least two types of ancillary items separately from one another and from hockey sticks, said external pockets disposed upon said housing member.

11. The bag according to claim 1, said housing member fabricated from a flexible material.

12. The bag according to claim 1, said housing member fabricated from a rigid material.

13. A hockey stick bag for enclosing and carrying hockey sticks, comprising:

a housing member enclosing an interior space configured to enclose and closely cooperate with a hockey stick therein, said housing member comprising a straight, elongated section, and a short, straight enlarged head arranged at an obtuse angle to said elongated section in the manner of a hockey stick, said enlarged head and said elongated section having two opposed, common planar surfaces extending along the entire length of said hockey stick bag;

at least one hand grip attached to said housing member, said hand grip raised above and projecting outside said housing member;

a closure disposed upon said enlarged head of said housing member, for selectively providing and closing access to said interior space of said housing member; and at least two external pockets for carrying at least two types of ancillary items separately from one another and from hockey sticks, said pockets disposed upon said housing member.

14. The bag according to claim 13, said bag having a distal end, said elongated section and said enlarged head meeting at a juncture, said bag forming an elbow at said juncture, said hand grip comprising a shoulder sling having a first point of anchorage disposed at said distal end of said bag and a second point of anchorage disposed inside said elbow of said bag, and means for removably attaching said shoulder sling to said housing member.

15. The bag according to claim 14, further comprising two small, rigid handles located abreast of one another and attached to said housing member.

16. The bag according to claim 13, said housing member fabricated from a flexible material.

17. The bag according to claim 13, said housing member fabricated from a rigid material.

18. A hockey stick bag for enclosing and carrying hockey sticks, comprising:

a housing member enclosing an interior space configured to enclose and closely cooperate with a hockey stick therein, said housing member comprising a straight, elongated section, and a short, straight enlarged head arranged at an obtuse angle to said elongated section in the manner of a hockey stick, said enlarged head and said elongated section having two opposed, common planar surfaces extending along the entire length of said bag;

at least one hand grip attached to said housing member; and a closure disposed upon said housing member, for selectively providing and closing access to said interior space of said housing member, said hand grip comprising a shoulder sling attached to said housing member, said elongated section and said enlarged head of said housing member meeting at a juncture, said housing member having an elbow formed at the juncture of said elongated section and said enlarged head, said bag having a distal end, said shoulder sling having a first point of anchorage disposed at said distal end of said bag and a second point of anchorage disposed inside said elbow of said bag.

* * * * *